US012342894B2

(12) United States Patent
Teetzel et al.

(10) Patent No.: US 12,342,894 B2
(45) Date of Patent: Jul. 1, 2025

(54) RECLINING HELMET MOUNT APPARATUS

(71) Applicant: WILCOX INDUSTRIES CORP., Newington, NH (US)

(72) Inventors: James W. Teetzel, Portsmouth, NH (US); Gary M. Lemire, Lee, NH (US)

(73) Assignee: Wilcox Industries Corp., Newington, NH (US)

( * ) Notice: Subject to any disclaimer, the term of this patent is extended or adjusted under 35 U.S.C. 154(b) by 91 days.

(21) Appl. No.: 18/388,903

(22) Filed: Nov. 13, 2023

(65) Prior Publication Data

US 2024/0156201 A1 May 16, 2024

Related U.S. Application Data

(60) Provisional application No. 63/425,443, filed on Nov. 15, 2022.

(51) Int. Cl.
*A42B 3/04* (2006.01)
*A42B 3/32* (2006.01)

(52) U.S. Cl.
CPC ..... *A42B 3/042* (2013.01); *A42B 3/324* (2013.01)

(58) Field of Classification Search
CPC ..... A42B 3/04; A42B 3/0406; A42B 3/042; A42B 3/221; G02B 23/125
See application file for complete search history.

(56) References Cited

U.S. PATENT DOCUMENTS

| | | | | |
|---|---|---|---|---|
| 3,503,146 | A * | 3/1970 | Woplin | G02B 27/01 40/485 |
| 5,526,178 | A * | 6/1996 | Goldstein | A42B 1/247 359/399 |
| 7,219,370 | B1 * | 5/2007 | Teetzel | F41G 1/30 2/6.2 |
| 8,209,780 | B1 * | 7/2012 | Lemire | A42B 3/04 2/6.6 |
| 8,375,473 | B2 | 2/2013 | Celona et al. | |
| 8,661,571 | B1 | 3/2014 | Teetzel et al. | |
| 8,739,313 | B2 | 6/2014 | Teetzel et al. | |
| 8,826,463 | B2 | 9/2014 | Teetzel et al. | |
| 8,984,665 | B2 | 3/2015 | Celona et al. | |
| 9,116,355 | B2 | 8/2015 | Teetzel et al. | |
| 9,243,870 | B2 | 1/2016 | Teetzel et al. | |
| 9,625,699 | B2 | 4/2017 | Teetzel et al. | |
| 9,709,792 | B2 | 7/2017 | Teetzel et al. | |
| 9,775,395 | B2 | 10/2017 | Teetzel et al. | |
| 9,778,453 | B2 | 10/2017 | Teetzel et al. | |

(Continued)

*Primary Examiner* — Jillian K Pierorazio
(74) *Attorney, Agent, or Firm* — McLane Middleton, Professional Association

(57) ABSTRACT

A helmet mount apparatus includes a reclining mount assembly having transversely spaced apart pivot arms. An upper end of each pivot arm is attached to a mount base member and configured for pivoting movement about a first transverse pivot axis. A lower end of each pivot arm is attached to a viewing device and configured for pivoting movement about a second transverse pivot axis. The pivot arms are pivotable about the first transverse pivot axis between a viewing position in front of an eye of a user and a stowed position above the helmet. The pivot arms are pivotable about the second transverse pivot axis to adjust a viewing angle of the viewing device or reduce a profile of the viewing device when the pivot arms are in the viewing position or stowed position, respectively.

20 Claims, 6 Drawing Sheets

(56) References Cited

U.S. PATENT DOCUMENTS 9,781,963 B1* 10/2017 Celona ..... A42B 3/223
10,004,289 B2 6/2018 Teetzel et al.
10,162,168 B2 12/2018 Teetzel et al.
10,264,840 B2 4/2019 Teetzel et al.
2007/0214551 A1 9/2007 Teetzel et al.
2010/0299814 A1* 12/2010 Celona ..... A42B 3/04 2/422
2011/0145981 A1* 6/2011 Teetzel ..... G02B 23/125 2/422
2011/0239354 A1* 10/2011 Celona ..... A42B 3/04 2/422
2012/0002046 A1* 1/2012 Rapoport ..... G02B 27/0176 348/E7.091
2013/0083391 A1* 4/2013 Teetzel ..... G02B 23/18 359/409
2014/0245523 A1* 9/2014 Teetzel ..... G02B 23/125 2/422
2014/0327962 A1 11/2014 Teetzel et al.
2014/0345181 A1 11/2014 Teetzel et al.
2014/0373423 A1 12/2014 Teetzel et al.
2015/0002930 A1* 1/2015 Teetzel ..... G02B 27/0149 359/409
2015/0074878 A1* 3/2015 Teetzel ..... A42B 3/04 2/422
2015/0264229 A1* 9/2015 Teetzel ..... H04N 23/56 348/376
2015/0323777 A1 11/2015 Teetzel et al.
2015/0323779 A1* 11/2015 Teetzel ..... G02B 23/16 359/409
2016/0216076 A1 7/2016 Teetzel et al.
2016/0324248 A1* 11/2016 Winters ..... A42B 3/04
2017/0184835 A1* 6/2017 Teetzel ..... G02B 27/0149
2019/0014846 A1* 1/2019 Teetzel ..... A42B 3/04
2020/0196698 A1* 6/2020 Winters ..... A42B 3/0406
2021/0244125 A1* 8/2021 Williams ..... A42B 3/0406
2022/0202126 A1 6/2022 Teetzel et al.
2023/0049355 A1* 2/2023 Lee ..... G02B 27/0176
2023/0152594 A1* 5/2023 Davidson ..... G06F 1/203 359/601

* cited by examiner

RECLINING HELMET MOUNT APPARATUS

CROSS REFERENCE TO RELATED APPLICATION

This application claims the priority benefit of U.S. provisional application No. 63/425,443 filed Nov. 15, 2022. The aforementioned application is incorporated herein by reference in its entirety.

BACKGROUND

The present disclosure relates to a helmet mount assembly and, in particular, to a reclining mount for alternately positioning a helmet mounted display which is mounted to a helmet or similar headgear between a viewable position and a stowed position. The present disclosure contemplates a new and improved helmet mount apparatus and method. The helmet mount apparatus is suited for mounting a display device such as a virtual reality (VR) display, augmented reality (AR) display, head up display (HUD), or other near eye display, although it is also amenable to mounting other viewing devices, including optical and electro-optical devices, including without limitation binoculars, night vision devices, electronic night vision devices, cameras such as thermal cameras, short wave infrared (SWIR) cameras, visors, face shields, optical filters and attenuators, and others.

SUMMARY

In one aspect, a helmet mount apparatus comprises a recliner mount assembly having a pair of transversely spaced apart pivot arms. An upper end of each pivot arm is attached to a mount base member and configured for pivoting movement about a first transverse pivot axis. A lower end of each pivot arm is attached to a viewing device and configured for pivoting movement about a second transverse pivot axis. The pivot arms are pivotable about the first transverse pivot axis between a viewing position wherein the viewing device is positioned in front of an eye of a user and a stowed position wherein the viewing device is positioned above the helmet. The pivot arms are pivotable about the second transverse pivot axis to adjust a viewing angle of the viewing device when the helmet mount apparatus is attached to the helmet and the pivot arms are in the viewing position and to reduce a profile of the viewing device with respect to the helmet when the helmet mount apparatus is attached to the helmet and the pivot arms are in the stowed position.

In a more limited aspect, the helmet mount apparatus further comprises a shroud attachable to a front of the helmet for detachably securing the recliner mount assembly.

In another more limited aspect, the recliner mount assembly includes an interface member releasably engaging the front shroud and a latch release button for disengaging the interface member from the front shroud.

In another more limited aspect, the interface member comprises a pair of vertical slide rails cooperating to form generally T-shaped cross sectional shape and having a channel therebetween. The vertical slide rails are slidably received within a T-shaped channel formed on a base of the recliner mount assembly. A vertical lock lever is secured to the base of the recliner mount assembly and engages a vertical lock post having a cam surface which interfaces with the T-shaped channel. Pivoting the vertical lock lever to a locked position causes the cam surface to interact with the pair of vertical slide rails to secure the base of the recliner mount assembly in a first desired vertical position relative to the helmet mount assembly interface member. Pivoting the vertical lock lever to a released position causes the cam surface to disengage from the pair of vertical slide rails to enabling the user to vertically move the base of the recliner mount assembly to a second desired vertical position relative to the helmet mount assembly interface member.

In another more limited aspect, the helmet mount apparatus further comprises a spring disposed between the vertical lock lever and the base of the recliner mount assembly to prevent movement or rattling between the recliner mount assembly and the interface member.

In another more limited aspect, the helmet mount apparatus further comprises a strap extending along a centerline of the helmet between the shroud and a rear attachment bracket attachable to a rear of the helmet.

In another more limited aspect, the helmet mount apparatus further comprises a battery attached to the rear attachment bracket for supplying power to the viewing device.

In another more limited aspect, the helmet mount apparatus of claim 1, further comprises an electrical interface configured to operable couple the viewing device to a host processing system disposed on the helmet.

In another more limited aspect, the electrical interface includes a Universal Serial Bus (USB) interface.

In another more limited aspect, wherein the mount base member includes a vertical adjustment mechanism operable to provide a vertical adjustment of the viewable device in relation to the eye of the user.

In another more limited aspect, the pivot arms are pivotable about the second transverse pivot axis to provide a continuous adjustment of the viewing angle of the viewing device.

In another more limited aspect, the pivot arms are pivotable about the second transverse pivot axis to position the viewing device further back on the helmet when the helmet mount apparatus is attached to the helmet and the pivot arms are in the stowed position.

In another more limited aspect, the recliner mount assembly comprises a base having left and right bores extending along the first pivot axis. Left and right detent members are captured within respective left and right openings in the base wherein the left and right detent members resiliently protrude into the respective left and right bores.

In another more limited aspect, the helmet mount apparatus further comprises left and right pivot posts received within the respective left and right bores. Each of the left and right pivot posts have a plurality of recesses formed therein configured to engage the detents left and right detent members, respectively. Each recess of the plurality of recesses is disposed at an angular position corresponding to a desired stop position of the pair of transversely spaced apart pivot arms.

In another more limited aspect, the upper end of a first one of the pivot arms is rigidly secured to the left pivot post and the upper end of a second one of the pivot arms is rigidly secured to the right pivot post.

In another more limited aspect, the lower end of each pivot arm is attached to a device mounting bracket, the device mounting bracket having one or more mounting receptacles, each of the mounting receptacles configured to receive a complementary mounting lug on the viewing device.

In another more limited aspect, the device mounting bracket has left and right pivot retainers having respective left and right arcuate grooves. The left and right arcuate grooves define a range of rotation of the device mounting bracket about the second transverse pivot axis. A left pin is affixed adjacent the lower end of a first one of the pivot arms and received within the left arcuate groove. A right pin is affixed adjacent the lower end of a second one of the pivot arms and received within the right arcuate groove. The left and right pins run in the left and right actuate grooves when the viewing device is pivoted with respect to the pair of transversely spaced apart pivot arms about the second transverse pivot axis.

In another more limited aspect, the helmet mount apparatus further comprises a left disc spring disposed intermediate the left pivot retainer and the lower end of a first one of the pivot arms and a right disc spring disposed intermediate the right pivot retainer and the lower end of a second one of the pivot arms. The left and right disc springs provide sufficient tensioning to resist pivoting movement of the device mounting bracket relative to the pair of transversely spaced apart pivot arms while also allowing the device mounting bracket to be manually pivoted.

In another aspect, a helmet assembly comprises in combination, the helmet mount apparatus and one or both of a helmet and a viewing device.

In another aspect, a method for adjusting an angle of a viewing device in relation to a helmet comprises providing a helmet mount apparatus, the helmet mount apparatus comprising: a recliner mount assembly having a pair of transversely spaced apart pivot arms; an upper end of each pivot arm attached to a mount base member and configured for pivoting movement about a first transverse pivot axis; a lower end of each pivot arm attached to a viewing device and configured for pivoting movement about a second transverse pivot axis; wherein the pivot arms are pivotable about the first transverse pivot axis between a viewing position wherein the viewing device is positioned in front of an eye of a user and a stowed position wherein the viewing device is positioned above the helmet; and wherein the pivot arms are pivotable about the second transverse pivot axis to adjust a viewing angle of the viewing device when the helmet mount apparatus is attached to the helmet and the pivot arms are in the viewing position and to reduce a profile of the viewing device with respect to the helmet when the helmet mount apparatus is attached to the helmet and the pivot arms are in the stowed position. A viewing device is attached to the lower end of each pivot arm. The viewing device is manually moved from a deployed position to a stowed position to cause the each of the pivot arms to pivot about the first transverse pivot axis until the viewing device is positioned above the helmet and behind a front edge of the helmet. The viewing device is manually pivoted about the second pivot axis to reduce the profile of the viewing device with respect to the helmet.

Various advantages and benefits of the present development will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Detailed embodiments of the present development are disclosed herein; however, it is to be understood that the disclosed embodiments are merely exemplary of the invention, which may be embodied in various forms. Therefore, specific structural and functional details disclosed herein are not to be interpreted as limiting but merely as a basis for the claims and as a representative basis for teaching one skilled in the art to variously employ the present inventive concept in virtually any appropriately detailed structure. Further, the terms and phrases used herein are not intended to be limiting but rather to provide an understandable description of the present development.

The terms "a" or "an," as used herein, are defined as one or more than one. The term "another," as used herein, is defined as at least a second or more. The terms "including" and/or "having" as used herein, are defined as comprising (i.e., open transition). The term "coupled" or "operatively coupled," as used herein, is defined as indirectly or directly connected.

As used in this application, the terms "front," "rear," "upper," "lower," "upwardly," "downwardly," "left," "right," and other orientation descriptors are intended to facilitate the description of the exemplary embodiment(s) of the present invention in relation to the provided figures, and are not intended to limit the structure thereof to any particular position or orientation.

Figure 1:
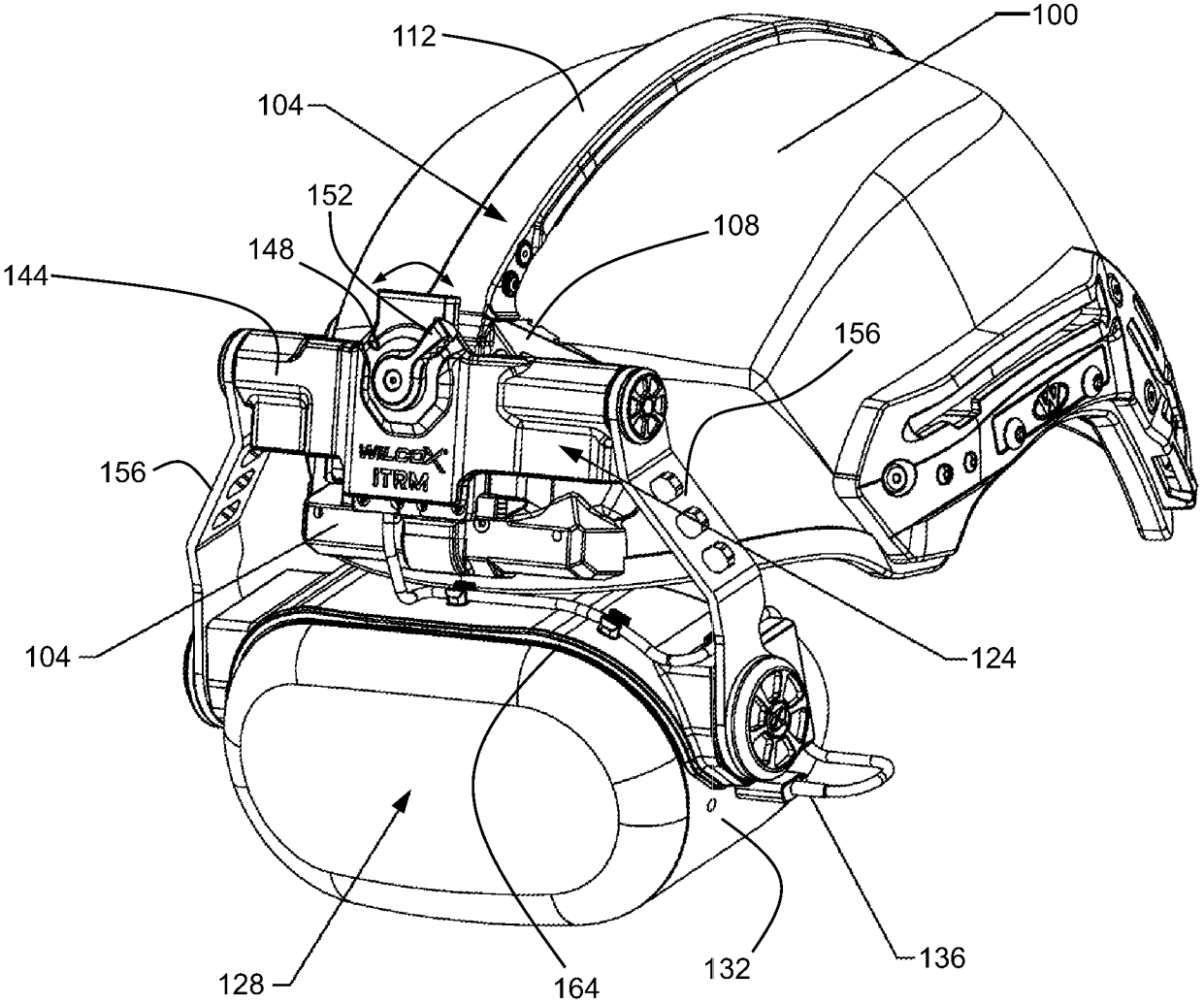
FIGS. 1 and 2 are isometric views of a helmet employing the reclining helmet mount apparatus in accordance with an exemplary embodiment.
Figure 2:
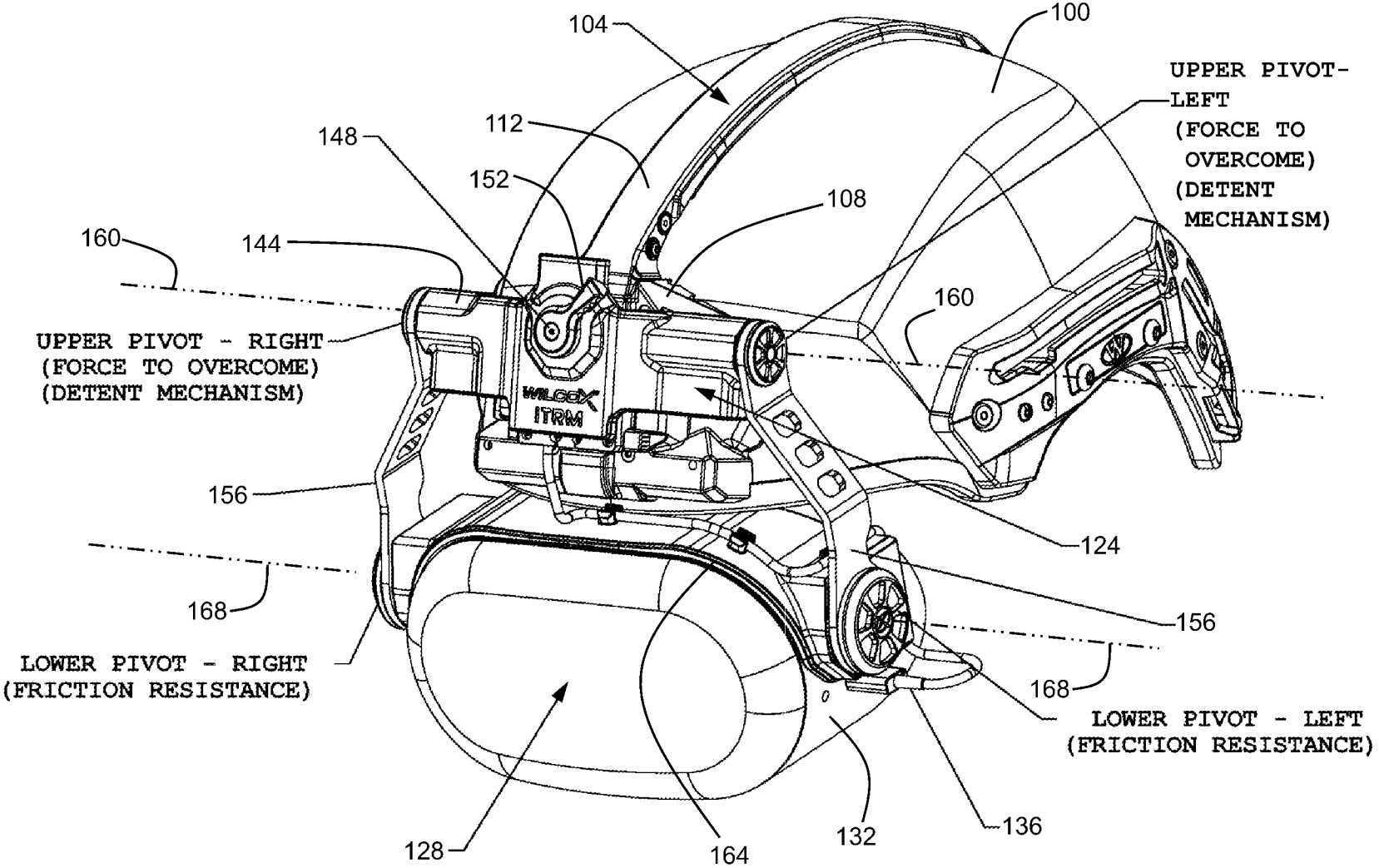
Figure 6:
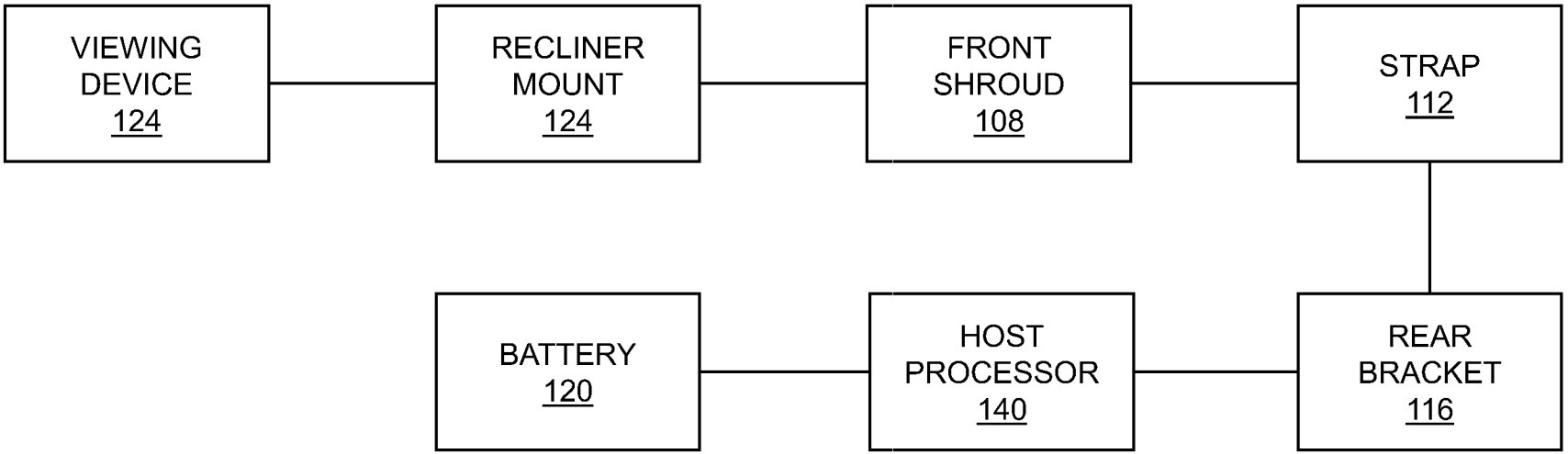
FIG. 6 is a block diagram of the helmet mounting apparatus herein.

Referring now to FIGS. 1 and 2, there is shown a helmet 100 having a helmet mount assembly 104. The helmet mount assembly 104 includes a front shroud 108 and a strap 112 extending along a centerline of the helmet 100. In embodiments, a rear attachment bracket or other fastener 116 (see FIG. 6) secures the helmet mount assembly 104 to the helmet 100. In embodiments, a power supply such as a battery or battery pack 120 (see FIG. 6) is secured to the rear bracket or mount 116. A recliner mount assembly 124 is releasably coupled to the front shroud 108 which, in turn, is releasably coupled to a viewing device 128. In embodiments, the viewing device 128 is electrically coupled to the power supply 120 (se FIG. 6) via an electrical interface 136, for example, USB, USB-C, micro-USB, or Lightning™ interface, although dedicated or proprietary interfaces and connectors are also contemplated. In embodiments, the viewing device 128 is operably coupled to a host processing system 140 disposed on the helmet via the USB interface 136.

In embodiments, the recliner mount assembly 124 includes a base member 144 having vertical adjustment mechanism 148. The vertical adjustment mechanism 148 includes a locking and unlocking lever 152, which is pivotable between a first, unlocked position and a second, locked position. When the lever 152 is in the unlocked position, the base 144 is slidable up and down with respect to the front shroud 108 to provide a vertical adjustment of the viewable device 128 in relation to the eyes of the user. The lever 152 is rotated to the locked position to secure the viewing device at the desired height.

Figure 3A:
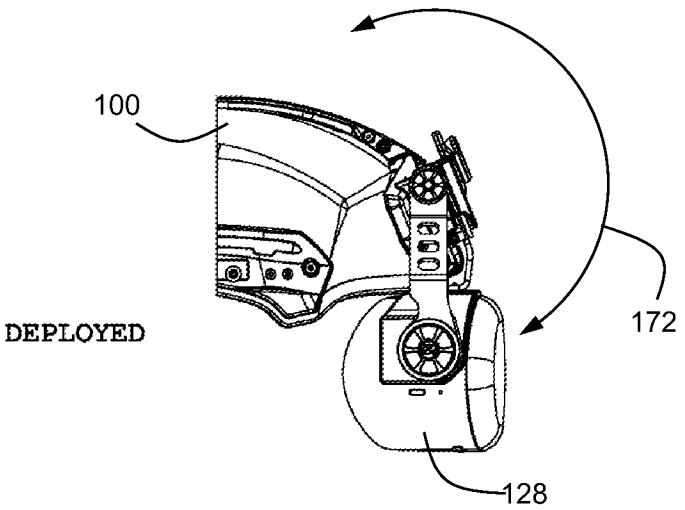
FIGS. 3A-3D are side views illustrating the arc path when transitioning the viewing device between the deployed position and the stowed position.
Figure 3B:
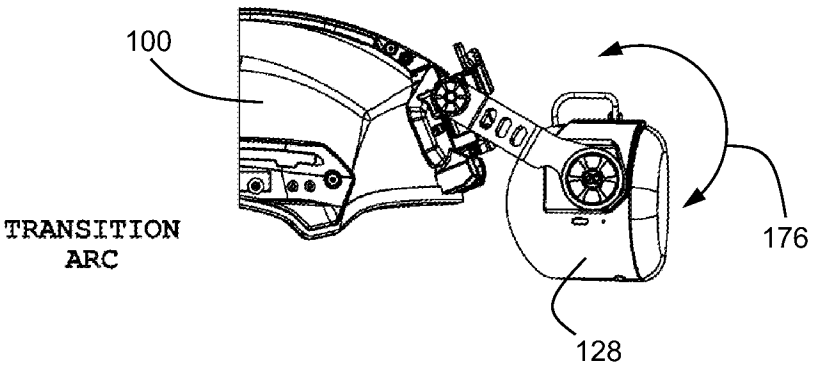
Figure 3C:
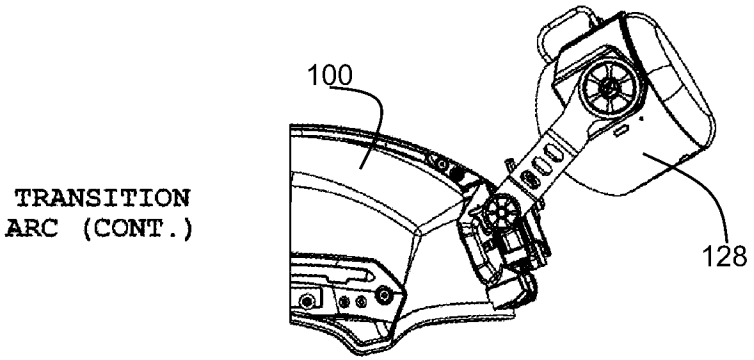
Figure 3D:
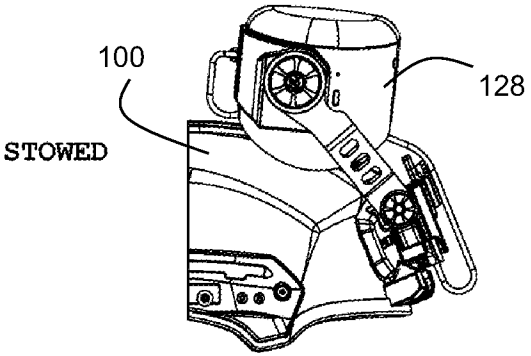

Left and right pivot arms 156 are each pivotally attached at an upper end thereof to opposite transverse sides of the base member 144. The left and right pivot arms 156 are manually pivotable about a first pivot axis 160. The left and right pivot arms 156 are pivotable between a deployed position (see FIG. 3A) and a stowed position (see FIG. 3D) and may be secured in place at the deployed and stowed positions using a detent mechanism as described in greater detail below. The detent mechanism includes one or more resilient protrusions engaging complementary recesses, wherein the protrusions are movable from the recesses upon manual application of force.

The left and right pivot arms 156 are each pivotally attached at a lower end thereof to opposite transverse sides of a device mounting bracket 164 attached to a housing 132 of the viewing device 128. The viewing device 128 is manually pivotable about a second pivot axis 168. The viewing device 128 is thereby pivotable to adjust the viewing angle of the device 128 with respect to the optical axis of the user's eye(s). In certain embodiments, the device viewing angle is continuously adjustable.

Figure 4:
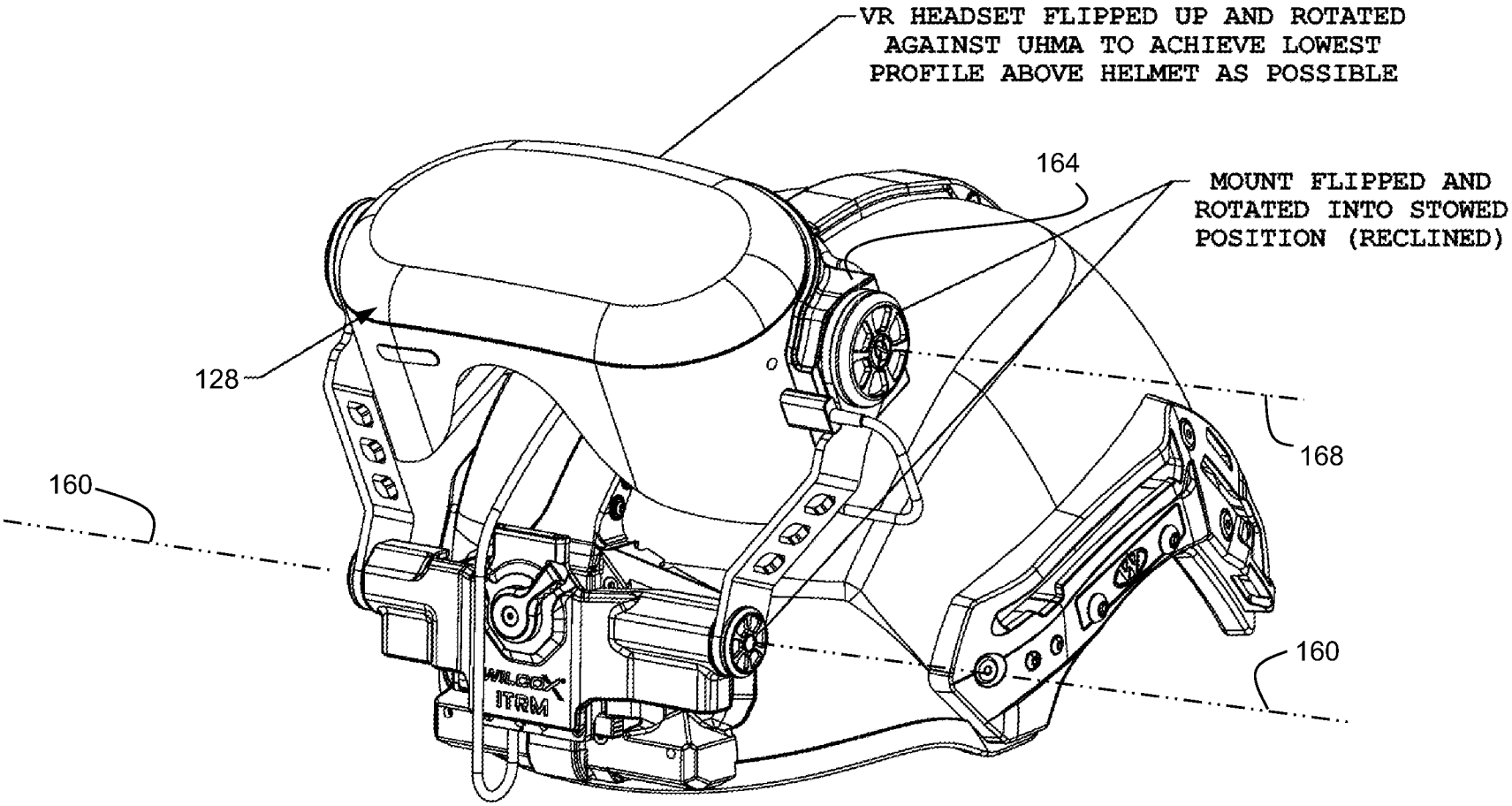
FIG. 4 is an isometric view showing the viewing device pivoted up to the stowed position.

Adjustment of the angle of the device 128 with respect to the pivot arms 156 about the second axis 168 also serves to ensure the viewing device 128 achieves the lowest profile possible when the viewing device is pivoted to the stowed position above the helmet 100. As best seen in FIGS. 3A-3D, when the user wishes to stow the device 128 on the helmet 100, the user manually moves the unit 128 from the deployed position (FIG. 3A) along a pivot arc 172 wherein the pivot arms 156 pivot about the first axis 160 via the intermediate positions appearing in FIGS. 3B and 3C until the device 128 is positioned above the helmet and behind the front edge of the helmet (see FIG. 3D). Additionally, as the device 128 travels along the pivot arc 172, the device 128 is also manually pivoted about the second pivot axis 168 along a pivot arc 176 to allow the device 128 to be moved back as far as possible on the helmet 100 and as close as possible to the helmet 100. By moving the device 128 closer to the helmet when stowed, the profile is reduced, thereby reducing the potential for snags, e.g., when the device is worn in areas with brush or other snag hazards. As best seen in FIG. 4, by moving the device 128 closer to and further back on the helmet 100, strain on the user's neck is also reduced when the device is worn in the stowed position.

Figure 5:
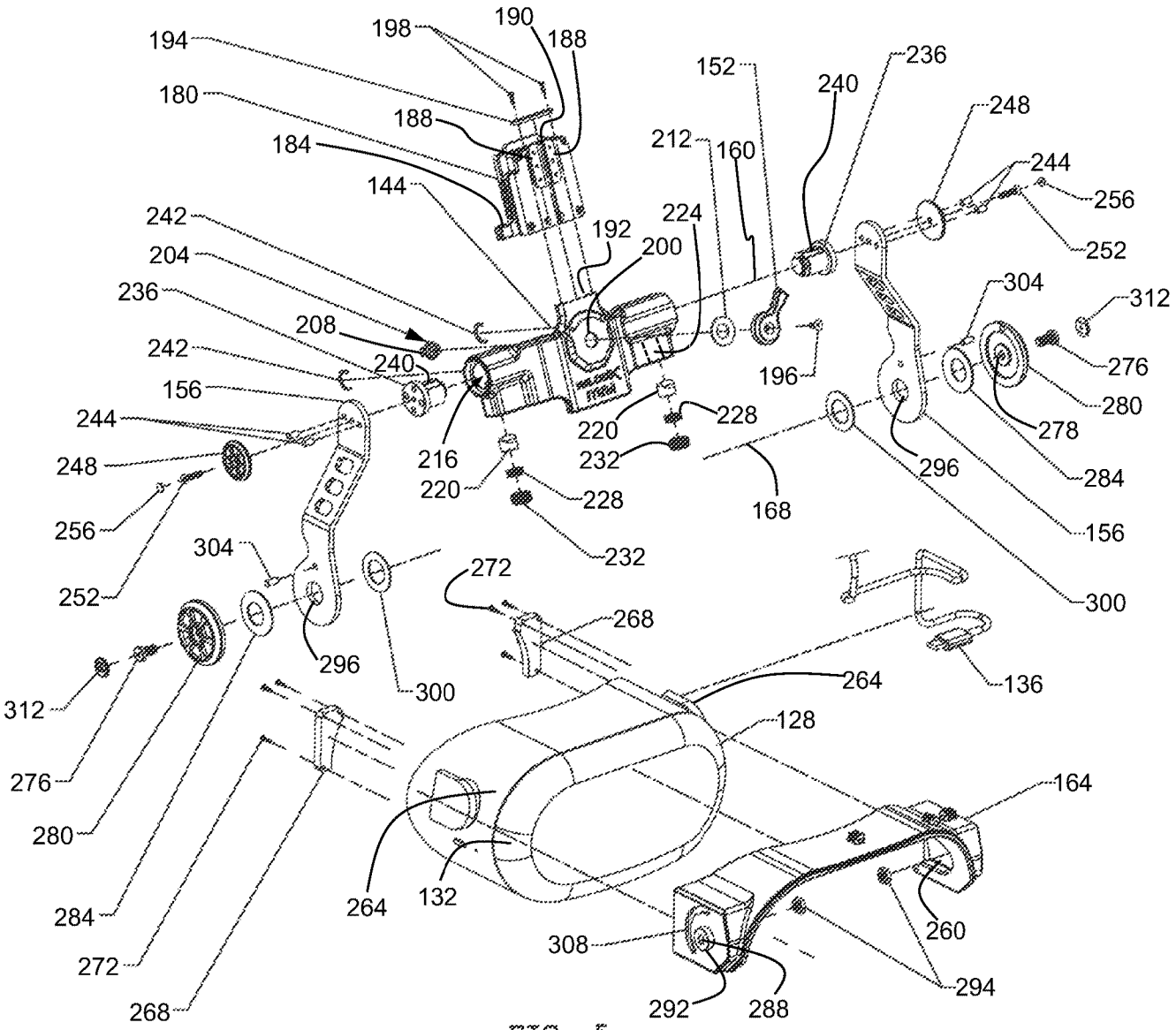
FIG. 5 is an exploded view of the recliner helmet mount apparatus appearing in FIGS. 1 and 2.

Referring now to FIG. 5, the recliner mount assembly 124 includes the base 144 which slidably engages a helmet mount assembly interface member 180. The helmet mount assembly interface member 180, in turn, releasably engages the front shroud 108. A latch release button 184 is provided to disengage the helmet mount assembly interface member 180 from the front shroud 108.

A pair of vertical slide rails 188 cooperates to form generally T-shaped cross sectional shape and having a channel 190 therebetween. The slide rails 188 are slidably received within a complementary T-shaped channel 192 on the base 144. The vertical lock lever 152 is secured to the mount base 144 via a threaded screw 196 which travels through a clearance opening 200 and engages a vertical lock post 204. The vertical lock post 204 includes cam surface 208 which interfaces with the channel 190. When the lever 152 is turned to the locked position, the cam lock surface 208 interacts with the slide rails 188 to secure the recliner mount base 144 in the desired vertical position relative to the helmet mount assembly interface member 180.

When the lever 152 is moved to the released position, the cam lock surface disengages from the locking slide rails 188 enabling the wearer to vertically move the recliner mount assembly 104 to the desired vertical position, i.e., in relation to the wearer's eye position and a desired line of sight. Once the desired vertical position is located, the lever 152 is moved back to the locked position. A disc spring 212 is disposed between the lever 152 and the base 144 to prevent movement or rattling between the recliner mount assembly 144 and the helmet mount assembly interface member 180. An upper dust cover 194 is secured to the base 144 using fasteners 198 to close the upper end of the channel 192.

The base 144 includes left and right bores 216 extending along the first pivot axis. A detent member 220 is captured within a respective opening 224 in the base 144 such that it resiliently protrudes into each of the bores 216. The detent member 220 is biased into the bore via a spring member 228, such as a stack of disc springs, and is secured in position via a threaded retainer/set screw 232.

Left and right pivot posts 236 are received within the left and right bores 216, respectively. Each pivot post 236 has a plurality of recesses 240 formed therein which are complementary with the detents 220. Each recess 240 is disposed at an angular position corresponding to a desired stop position of the pivot arms 156. In certain embodiments, each pivot post 236 has a first recess 240 which is engaged by the detent 220 when the pivot arm 156 is in the deployed position and a second recess 240 which is engaged by the detent 220 when the pivot arm 156 is in the stowed position. The pivot posts 236 are secured within the respective bores via retaining rings 242.

The pivot arms 156 are rigidly secured to the respective pivot posts 236 via dowel pins 244 and retained via an upper retainer 248. A threaded fastener 252 passes through a central clearance opening in the retainer 248. A screw cover 256 is disposed over the head of each threaded fastener 252, e.g., via a snap fit, friction fit, press fit, or interference fit, to prevent inadvertent loosening of the fastener 252.

The device mounting bracket 164 illustrated is a configured for attaching a virtual reality or augmented reality headset 128 although other helmet mounted devices are also contemplated as described above. The bracket 164 includes channels 260 that slidably receive mounting lugs 264 on the device housing 132, e.g., in tongue and groove fashion, although other mounting configurations, such as a dovetail mounting configuration, are also contemplated. Covers 268 are secured over the open end of the channels 260 via fasteners 272 to secure the device 128 to the bracket 164.

Left and right threaded fasteners 276 pass through central clearance openings 278 in respective left and right lower pivot retainers 280 which lie along the second pivot axis 168. Left and right disc springs 284 are disposed intermediate the respective lower pivot retainers 280 and the lower ends of the pivot arms 156. The disc springs provide tensioning to resist pivoting movement of the headset bracket 164 relative to the pivot arms 156, while allowing the bracket 164 to be manually pivoted a desired viewing angle of the device 128. Each threaded fastener 276 passes through a central opening 288 in a pivot boss 292 on the bracket 164 and threadably engages a hex nut 294. Each boss 292 is received in an aligned opening 296 in the lower end of the pivot arms 156. Left and right spacers 300 are disposed intermediate the bracket 164 and the pivot arms 156. Left and right pins 304 run in respective arcuate grooves 308 to limit the range of rotation of the bracket 164 about the second pivot axis 168. A screw cap 312 is disposed over the head of each threaded fastener 276, e.g., via a snap fit, friction fit, press fit, or interference fit, to prevent inadvertent loosening of the fastener 276.

The invention has been described with reference to the preferred embodiment. Modifications and alterations will occur to others upon a reading and understanding of the preceding detailed description. It is intended that the invention be construed as including all such modifications and alterations insofar as they come within the scope of the appended claims or the equivalents thereof

What is claimed is:

1. A helmet mount apparatus, comprising:

a recliner mount assembly having a pair of transversely spaced apart pivot arms;

an upper end of each pivot arm attached to a mount base member and configured for pivoting movement about a first transverse pivot axis;

a lower end of each pivot arm attached to a viewing device and configured for pivoting movement about a second transverse pivot axis;

wherein the pivot arms are pivotable about the first transverse pivot axis between a viewing position wherein the viewing device is positioned in front of an eye of a user and a stowed position wherein the viewing device is positioned above the helmet; and wherein the pivot arms are pivotable about the second transverse pivot axis to adjust a viewing angle of the viewing device when the helmet mount apparatus is attached to the helmet and the pivot arms are in the viewing position and to reduce a profile of the viewing device with respect to the helmet when the helmet mount apparatus is attached to the helmet and the pivot arms are in the stowed position.

2. The helmet mount apparatus of claim 1, further comprising a shroud attachable to a front of the helmet for detachably securing the recliner mount assembly.

3. The helmet mount apparatus of claim 2, wherein the recliner mount assembly includes an interface member releasably engaging the front shroud and a latch release button for disengaging the interface member from the front shroud.

4. The helmet mount apparatus of claim 3, wherein the interface member comprises:

a pair of vertical slide rails cooperating to form generally T-shaped cross sectional shape and having a channel therebetween;

the vertical slide rails slidably received within a T-shaped channel formed on a base of the recliner mount assembly;

a vertical lock lever secured to the base of the recliner mount assembly, the vertical lock lever engaging a vertical lock post having a cam surface which interfaces with the T-shaped channel, wherein pivoting the vertical lock lever to a locked position causes the cam surface to interact with the pair of vertical slide rails to secure the base of the recliner mount assembly in a first desired vertical position relative to the helmet mount assembly interface member; and wherein pivoting the vertical lock lever to a released position causes the cam surface to disengage from the pair of vertical slide rails to enabling the user to vertically move the base of the recliner mount assembly to a second desired vertical position relative to the helmet mount assembly interface member.

5. The helmet mount apparatus of claim 4, further comprising a spring disposed between the vertical lock lever and the base of the recliner mount assembly to prevent movement or rattling between the recliner mount assembly and the interface member.

6. The helmet mount apparatus of claim 2, further comprising a strap extending along a centerline of the helmet between the shroud and a rear attachment bracket attachable to a rear of the helmet.

7. The helmet mount apparatus of claim 6, further comprising a battery attached to the rear attachment bracket for supplying power to the viewing device.

8. The helmet mount apparatus of claim 1, further comprising an electrical interface configured to operable couple the viewing device to a host processing system disposed on the helmet.

9. The helmet mount apparatus of claim 1, wherein the electrical interface includes a Universal Serial Bus (USB) interface.

10. The helmet mount apparatus of claim 1, wherein the mount base member includes a vertical adjustment mechanism operable to provide a vertical adjustment of the viewable device in relation to the eye of the user.

11. The helmet mount apparatus of claim 1, wherein the pivot arms are pivotable about the second transverse pivot axis to provide a continuous adjustment of the viewing angle of the viewing device.

12. The helmet mount apparatus of claim 1, wherein the pivot arms are pivotable about the second transverse pivot axis to position the viewing device further back on the helmet when the helmet mount apparatus is attached to the helmet and the pivot arms are in the stowed position.

13. The helmet mount apparatus of claim 1, further comprising:

the recliner mount assembly comprising a base having left and right bores extending along the first pivot axis;

left and right detent members captured within respective left and right openings in the base wherein the left and right detent members resiliently protrude into the respective left and right bores.

14. The helmet mount apparatus of claim 13, further comprising:

left and right pivot posts received within the respective left and right bores;

each of the left and right pivot posts having a plurality of recesses formed therein configured to engage the detents left and right detent members, respectively;

each recess of the plurality of recesses being disposed at an angular position corresponding to a desired stop position of the pair of transversely spaced apart pivot arms.

15. The helmet mount apparatus of claim 14, wherein the upper end of a first one of the pivot arms is rigidly secured to the left pivot post and the upper end of a second one of the pivot arms is rigidly secured to the right pivot post.

16. The helmet mount apparatus of claim 1, further comprising:

the lower end of each pivot arm attached to a device mounting bracket, the device mounting bracket having one or more mounting receptacles, each of the one or more mounting receptacles configured to receive a complementary mounting lug on the viewing device.

17. The helmet mount apparatus of claim 16, further comprising:

the device mounting bracket having left and right pivot retainers having respective left and right arcuate grooves, the left and right arcuate grooves defining a range of rotation of the device mounting bracket about the second transverse pivot axis;

a left pin affixed adjacent the lower end of a first one of the pivot arms and received within the left arcuate groove;

a right pin affixed adjacent the lower end of a second one of the pivot arms and received within the right arcuate groove;

the left and right pins running in the left and right actuate grooves when the viewing device is pivoted with respect to the pair of transversely spaced apart pivot arms about the second transverse pivot axis.

18. The helmet mount apparatus of claim 17, further comprising:

a left disc spring disposed intermediate the left pivot retainer and the lower end of a first one of the pivot arms and a right disc spring disposed intermediate the right pivot retainer and the lower end of a second one of the pivot arms;

wherein the left and right disc springs provide sufficient tensioning to resist pivoting movement of the device mounting bracket relative to the pair of transversely spaced apart pivot arms while also allowing the device mounting bracket to be manually pivoted.

19. A helmet assembly comprising, in combination, the helmet mount apparatus of claim 1 and one or both of:

a helmet; and a viewing device.

20. A method for adjusting an angle of a viewing device in relation to a helmet, the method comprising:

providing a helmet mount apparatus comprising:

a recliner mount assembly having a pair of transversely spaced apart pivot arms;

an upper end of each pivot arm attached to a mount base member and configured for pivoting movement about a first transverse pivot axis;

a lower end of each pivot arm attached to a viewing device and configured for pivoting movement about a second transverse pivot axis;

wherein the pivot arms are pivotable about the first transverse pivot axis between a viewing position wherein the viewing device is positioned in front of an eye of a user and a stowed position wherein the viewing device is positioned above the helmet; and wherein the pivot arms are pivotable about the second transverse pivot axis to adjust a viewing angle of the viewing device when the helmet mount apparatus is attached to the helmet and the pivot arms are in the viewing position and to reduce a profile of the viewing device with respect to the helmet when the helmet mount apparatus is attached to the helmet and the pivot arms are in the stowed position;

attaching a viewing device to the lower end of each pivot arm;

manually moving the viewing device from a deployed position to a stowed position to cause the each of the pivot arms to pivot about the first transverse pivot axis until the viewing device is positioned above the helmet and behind a front edge of the helmet; and manually pivoting the viewing device about the second pivot axis to reduce the profile of the viewing device with respect to the helmet.

* * * * *